US011591796B2

(12) United States Patent
Naylor et al.

(10) Patent No.: US 11,591,796 B2
(45) Date of Patent: Feb. 28, 2023

(54) TRUSS FORMED OF FOLDED SHEET METAL

(71) Applicant: Bok Modern LLC, San Rafael, CA (US)

(72) Inventors: Russell Naylor, San Rafael, CA (US); Hearee S. Chu, San Francisco, CA (US)

(73) Assignee: Bok Modern LLC, San Rafael, CA (US)

( * ) Notice: Subject to any disclaimer, the term of this patent is extended or adjusted under 35 U.S.C. 154(b) by 0 days.

(21) Appl. No.: 17/336,034

(22) Filed: Jun. 1, 2021

(65) Prior Publication Data

US 2021/0372126 A1 Dec. 2, 2021

Related U.S. Application Data

(60) Provisional application No. 63/033,763, filed on Jun. 2, 2020.

(51) Int. Cl.
*E04C 3/07* (2006.01)
*E04C 3/11* (2006.01)
(Continued)

(52) U.S. Cl.
CPC ..... *E04C 3/07* (2013.01); *E04B 1/34* (2013.01); *E04B 7/026* (2013.01); *E04C 2/08* (2013.01);
(Continued)

(58) Field of Classification Search
CPC ..... E04C 2/08; E04C 2/34; E04C 2002/3488; E04C 3/07; E04C 3/11; E04C 2003/0413; E04C 2003/043; E04C 2003/0486; E04C 2003/0465; E04C 2003/0469; E04C 2003/0491; E04C 2003/0495; E04B 1/34; E04B 2001/1987; E04B 7/026; E04B 2103/06
See application file for complete search history.

(56) References Cited

U.S. PATENT DOCUMENTS 1,738,854 A * 12/1929 Thies ..... E04C 3/40 52/643
2,446,457 A * 8/1948 Braun ..... E04C 3/09 52/847
(Continued)

FOREIGN PATENT DOCUMENTS

DE 1004789 B * 3/1957
GB 1586306 A * 3/1981 ..... E04C 3/08

*Primary Examiner* — Christine T Cajilig
(74) *Attorney, Agent, or Firm* — Brian Beverly; Beeson Skinner Beverly, LLP

(57) ABSTRACT

A truss includes a plurality of truss members, each truss member formed from a unitary folded blank of sheet metal to create a main panel, and proximal and distal flanges and a horizontal panel each extending perpendicularly from the main panel, the proximal flange of a first truss member is connected to the distal flange of a second truss member to form a truss. In one embodiment employing trusses formed of folded sheet metal, a plurality of interconnected truss modules, each truss module including a plurality of truss members, forms a plurality of oppositely extending horizontal flanges that collectively present the top and bottom surfaces of a cantilevered canopy.

20 Claims, 10 Drawing Sheets

(51) Int. Cl.

| | |
|---|---|
| ***E04C 2/08*** | (2006.01) |
| ***E04C 2/34*** | (2006.01) |
| ***E04B 1/34*** | (2006.01) |
| ***E04B 7/02*** | (2006.01) |
| ***E04C 3/04*** | (2006.01) |

(52) U.S. Cl.
CPC ..... *E04C 2/34* (2013.01); *E04C 3/11* (2013.01); *E04B 2103/06* (2013.01); *E04C 2002/3488* (2013.01); *E04C 2003/043* (2013.01); *E04C 2003/0413* (2013.01); *E04C 2003/0465* (2013.01)

(56) References Cited

U.S. PATENT DOCUMENTS

| | | | | | |
|---|---|---|---|---|---|
| 2,918,992 | A * | 12/1959 | Gelsavage | E04B 1/3211 | 52/762 |
| 3,881,284 | A * | 5/1975 | Martin | E04B 1/3211 | 52/81.1 |
| 4,531,333 | A * | 7/1985 | Huegy | E04B 1/3211 | 52/81.2 |
| 9,770,793 | B2 * | 9/2017 | Kawecki | E04C 3/09 | |
| 2006/0042180 | A1 * | 3/2006 | Williams | A63H 33/06 | 52/633 |
| 2007/0289229 | A1 * | 12/2007 | Aldo | E04B 7/20 | 52/90.1 |
| 2012/0159895 | A1 * | 6/2012 | Kawecki | B23P 15/00 | 52/834 |

* cited by examiner

TRUSS FORMED OF FOLDED SHEET METAL

CROSS-REFERENCE TO RELATED APPLICATIONS

This application claims the benefit of U.S. Provisional Application No. 63/033,763 filed Jun. 2, 2020 and which is fully incorporated herein by reference.

BACKGROUND

Technical Field

This invention is directed to structural trusses and particularly to structural trusses for buildings fabricated from a plurality of truss members each of which is formed of a unitary blank of folded sheet metal.

Description of Related Art

A truss is a structural member usually fabricated from straight pieces of metal or timber to form a series of triangles lying in a single plane. A truss gives a stable form capable of supporting considerable external load over a large span with the component parts stressed primarily in axial tension or compression.

Conventionally, modern trusses are made up of a series of various length angle steel pieces that are either welded or bolted together to form a whole that is much stronger that the sum of the parts. Two commonly used truss systems are shown in FIG. 1.

While traditional trusses are extremely strong and structurally sound, they are generally constructed using large, heavy steel beams and are often constructed separately off-site to be transported as a whole to the construction site. Installing trusses typically requires use of a crane to lift the truss in position until it is secured in place.

Were it possible to construct a truss from lighter weight sheet metal, such trusses could be constructed on site from component pieces, at lower cost, resulting in a lighter structure.

SUMMARY OF THE INVENTION

A truss member according to the invention is formed from a unitary folded blank of sheet metal. The blank is folded to create a main panel surrounded by proximal and distal flanges and a horizontal panel which extend rearward perpendicularly from the main panel. In one embodiment, the proximal and distal flanges and the horizontal panel of each truss member are joined together at their short edges to strengthen the folded configuration.

A plurality of truss members can be joined together by joining the proximal flange of one truss member with the distal flange of another in alternating vertical orientations to form a linear truss.

In another embodiment a plurality of truss members having oppositely extending horizontal panels are attached to form a truss module, and a plurality of interconnected adjacent truss modules is attached to the face of a building to form a cantilevered canopy.

DETAILED DESCRIPTION OF THE ILLUSTRATED EMBODIMENT

Figure 1:
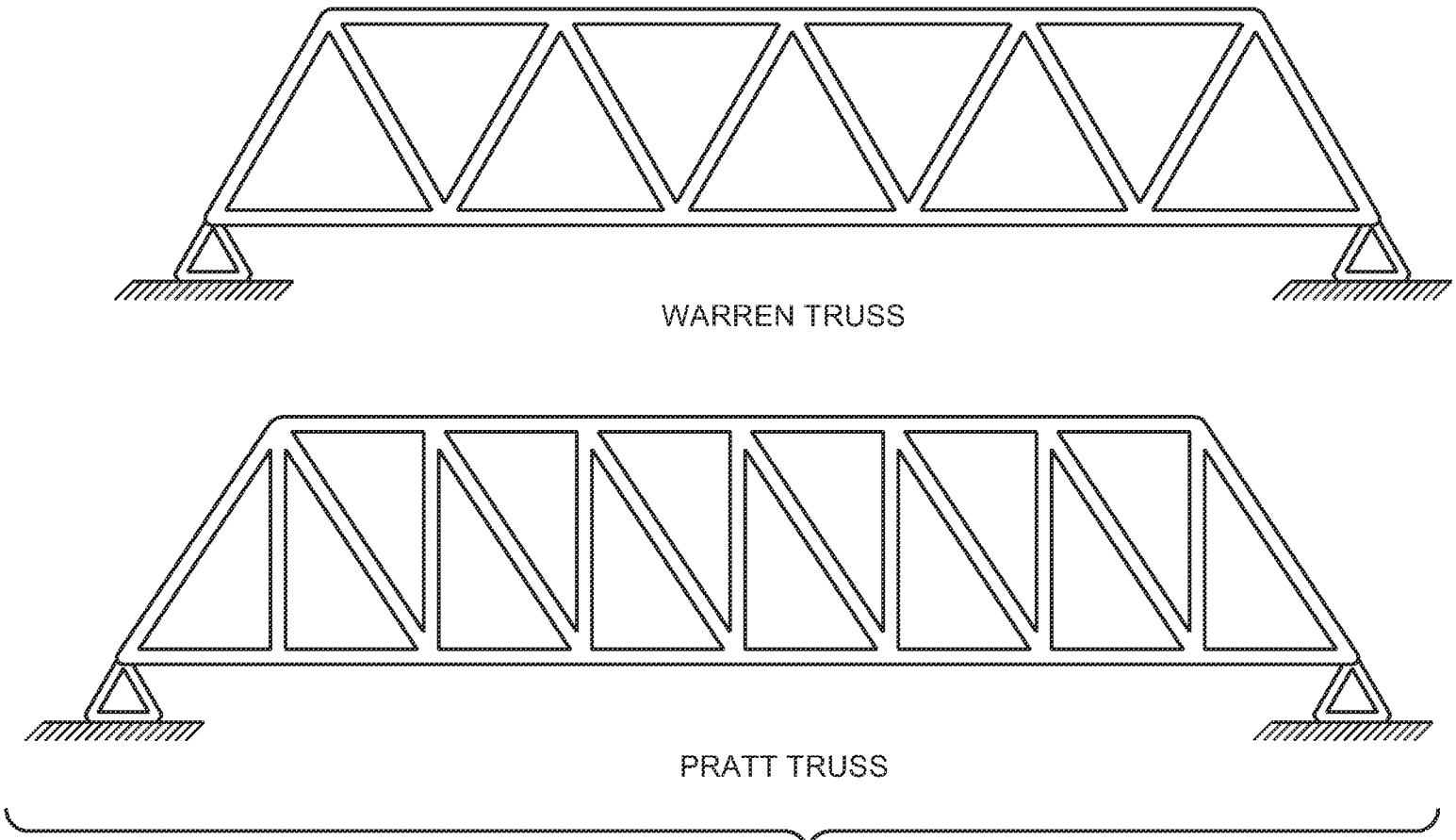
FIG. 1 (PRIOR ART)
FIG. 1 depicts two exemplary trusses found in the prior art.
Figure 2:
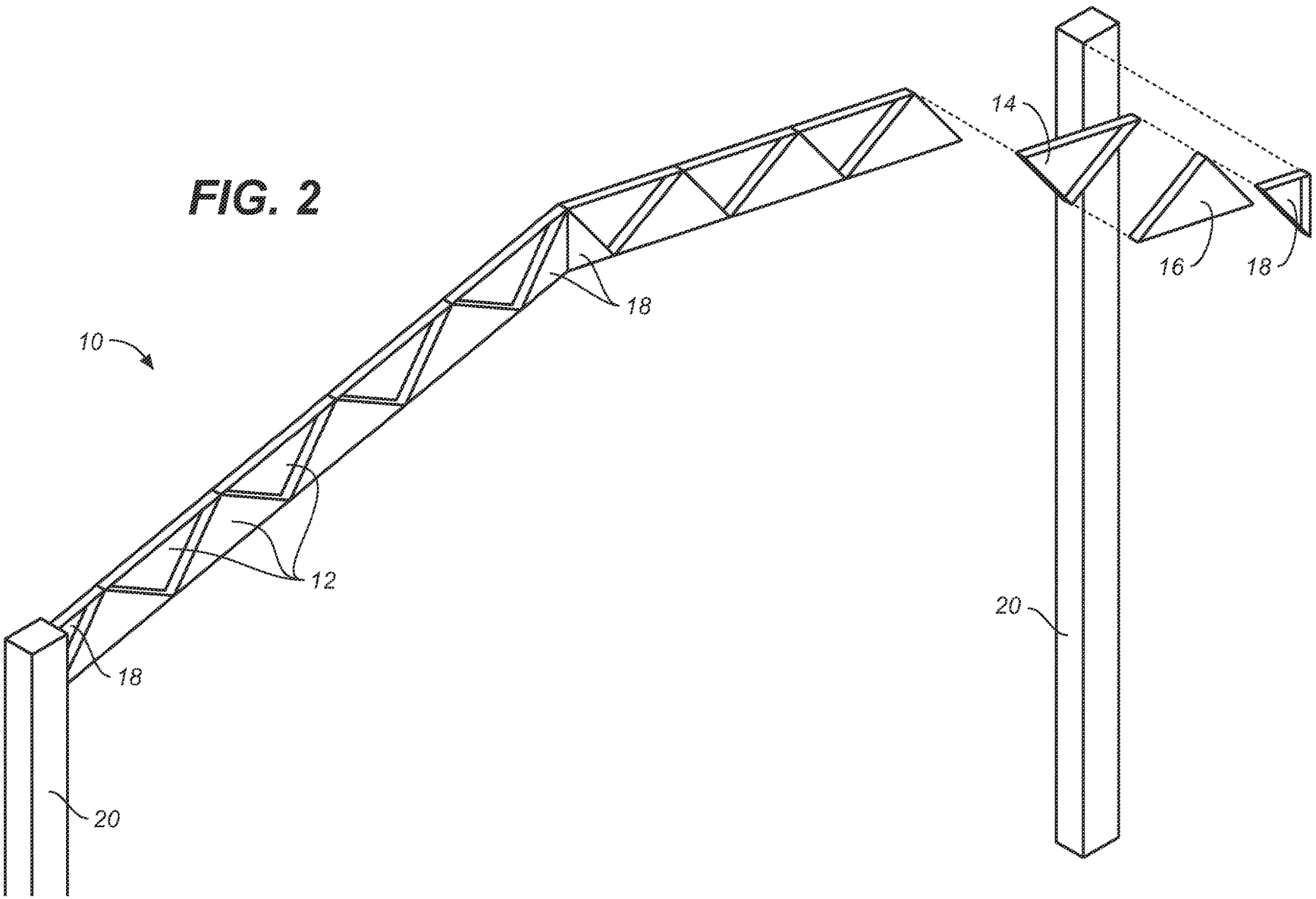
FIG. 2 is an upper left perspective view of a truss formed from multiple folded sheet metal blanks according to the invention showing a couple of representative individual truss members broken out.

A truss according to the invention, referred to generally at 10 in FIG. 2, comprises a plurality of truss members 12 including first and second truss members 14 and 16. As described below, the truss is formed by attaching individual truss members 12 together. In the embodiment illustrated in FIG. 2, the truss forms a ridge by varying the shape of transition truss members 18. The shapes of truss members 12, 14, 16 can also be manipulated to form the truss into other shapes such as a curved arch or a linear support. The truss 10, shape regardless, generally extends between support members such as posts 20 to tie the support members together or support other elements of a structure. In some embodiments the truss 10 may extend from only one support member such as posts 20, or it may extend from a vertical face such as a wall to create a cantilevered structure such as the canopy shown in FIG. 7.

Figure 3:
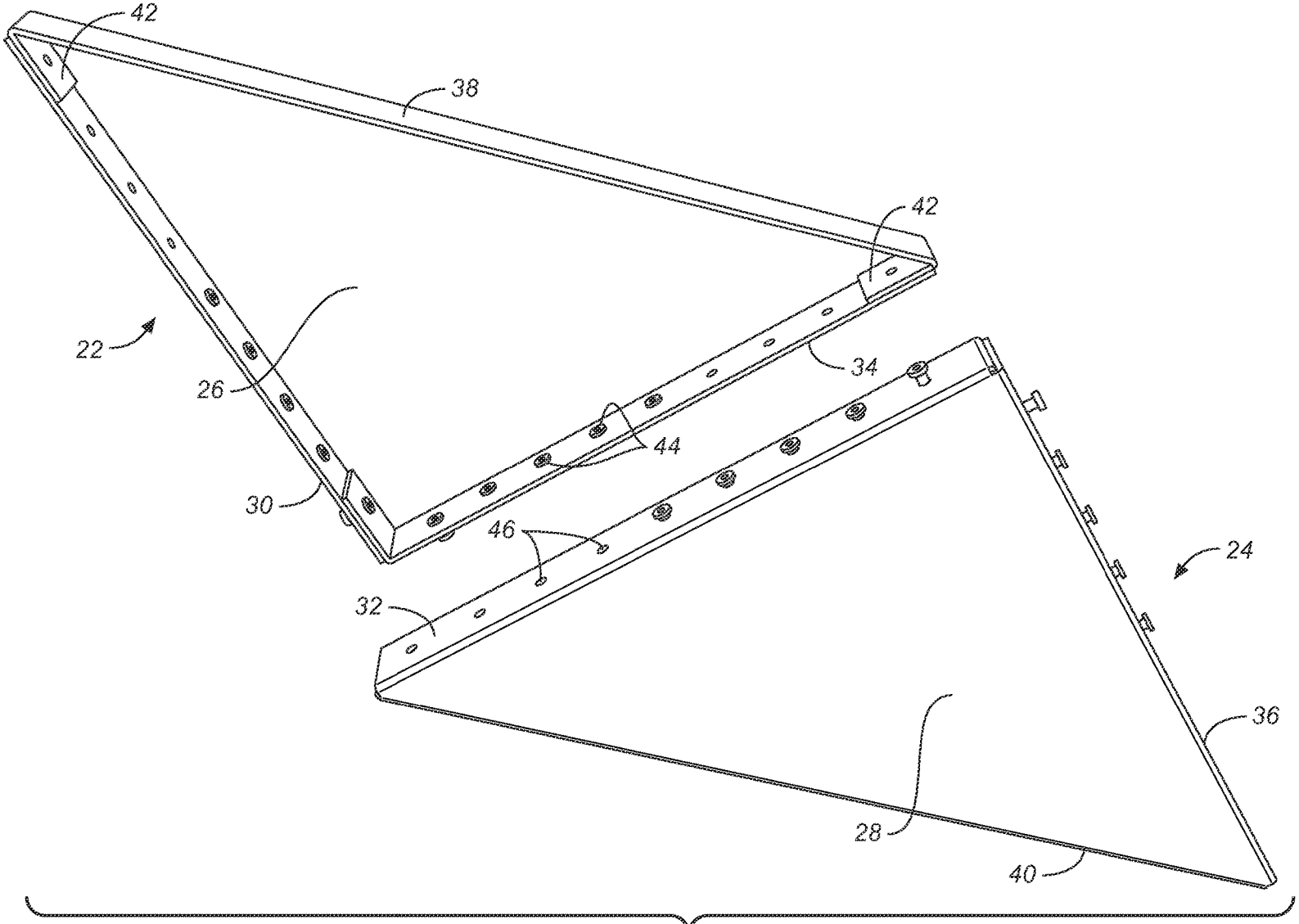
FIG. 3 a close up perspective view of two individual truss members such as shown in FIG. 2.

With reference now to FIG. 3, it is seen that truss members 22, 24 include main panels 26 and 28, respectively, proximal flanges 30, 32, respectively, distal flanges 34 and 36, respectively, and horizontal panels 38 and 40, respectively. Each of the proximal and distal flanges 30, 32, 34, 36 and the horizontal panels 38, 40 are folded perpendicularly with respect to main panels 26 and 28 to create a triangular structure in which each of the proximal and distal flanges and the horizontal panels form truss chords. In some embodiments, the ends of the truss flanges and the horizontal panel are connected together using tabs 42 folded from one of the flanges or panel. The truss members 22, 24 have favorable structural properties due to the strength of the truss chords formed by the proximal and distal flanges and the horizontal panels, which is enhanced by their integral connection to the main panels 26, 28. Truss members 26, 28 can be joined together using fasteners 44 inserted through fastener holes 46, or by welding, gluing, or other conventional means.

Figure 4:
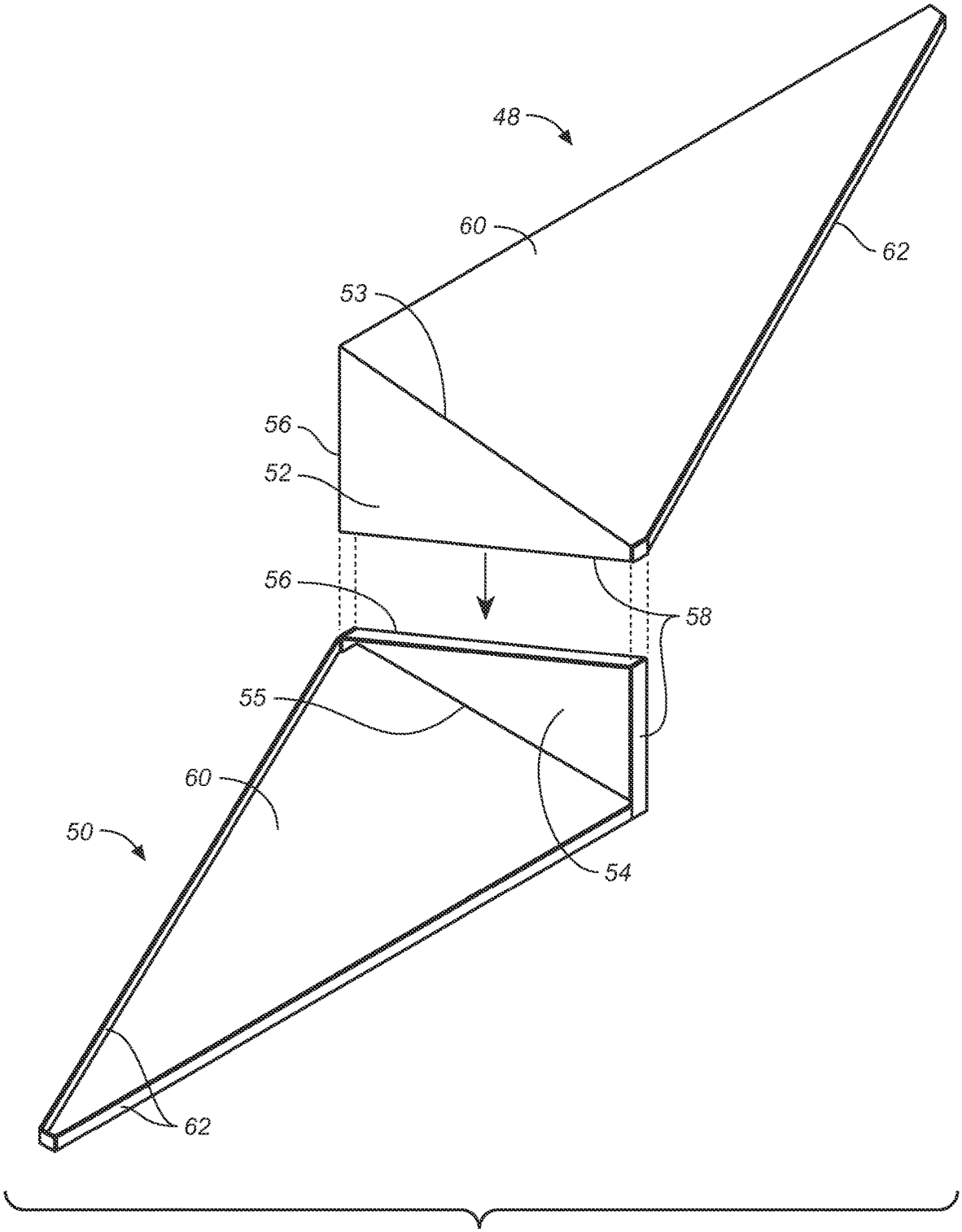
FIG. 4 is a perspective view of another embodiment of a pair of truss members according to the invention.

In another embodiment of the invention, shown in FIG. 4, top and bottom truss members 48 and 50 share a similar structural configuration as truss members 22, 24 shown in FIG. 3, having main panels 52 and 54, respectively, proximal flanges 56, distal flanges 58, and horizontal panels 60, wherein the proximal flange 56 of truss member 50 is attached to the distal flange 58 of truss member 48 as indicated by the downward arrow, but horizontal panels 60 extend in opposite directions from the main panels 52, 54 from top and bottom fold lines 53 and 55, respectively to present vertically spaced prominent horizontal surfaces. In the illustrated embodiment, horizontal panels 60 have a triangular configuration, but they could assume any other shape. Stiffening flanges 62 are provided along the long edges thereof to strengthen and rigidify horizontal panels 60.

Figure 5:
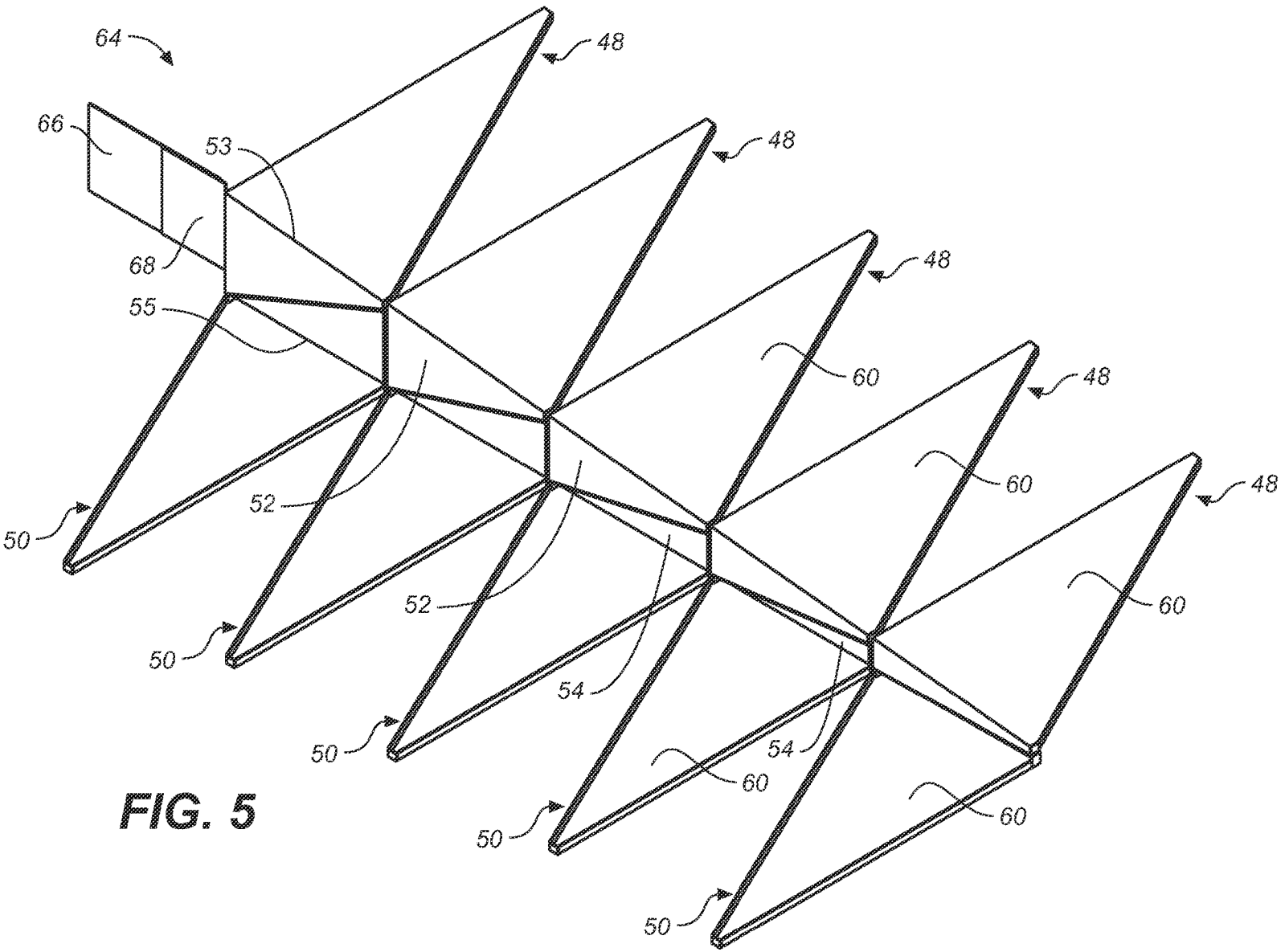
FIG. 5 is an upper perspective view of a cantilevered truss module formed from multiple truss members according to the invention.

With additional reference now to FIG. 5, it can be seen that the main panels 52, 54 of a plurality of truss members 48, 50 are joined together to form a truss module, indicated generally at numeral 64, having a linear center truss formed by center panels 52, 54 with upper and lower boundaries defined by fold lines 58 that supports horizontal panels 60. In the illustrated embodiment, main panels 52, 54 are disposed in a vertical plane. The truss module 64 may be attached to the face of a building or to another support structure using embedment plate 66 and anchor bracket 68 or other suitable attachment mechanisms.

Figure 6A:
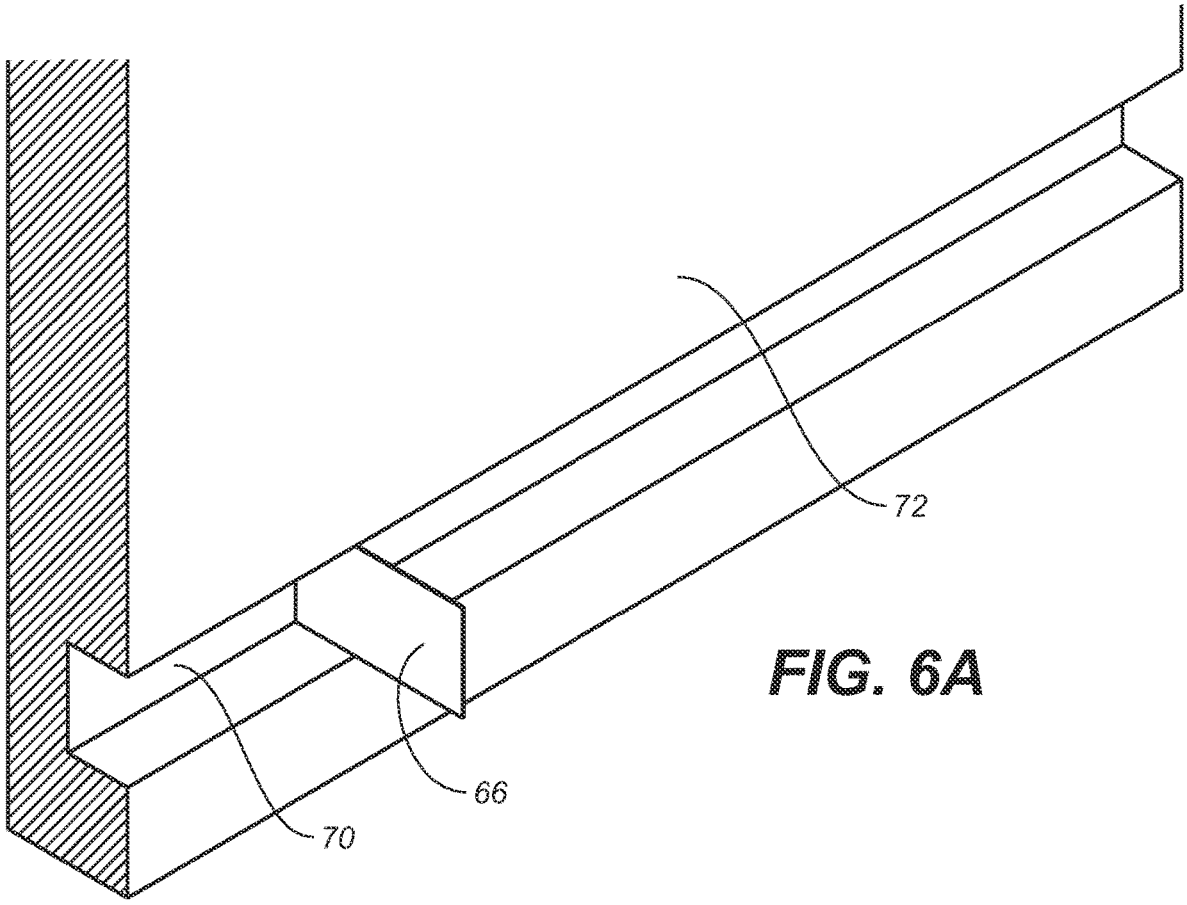
FIGS. 6A-6D are upper perspective views of stages of installation of a plurality of cantilevered truss modules.
Figure 6B:
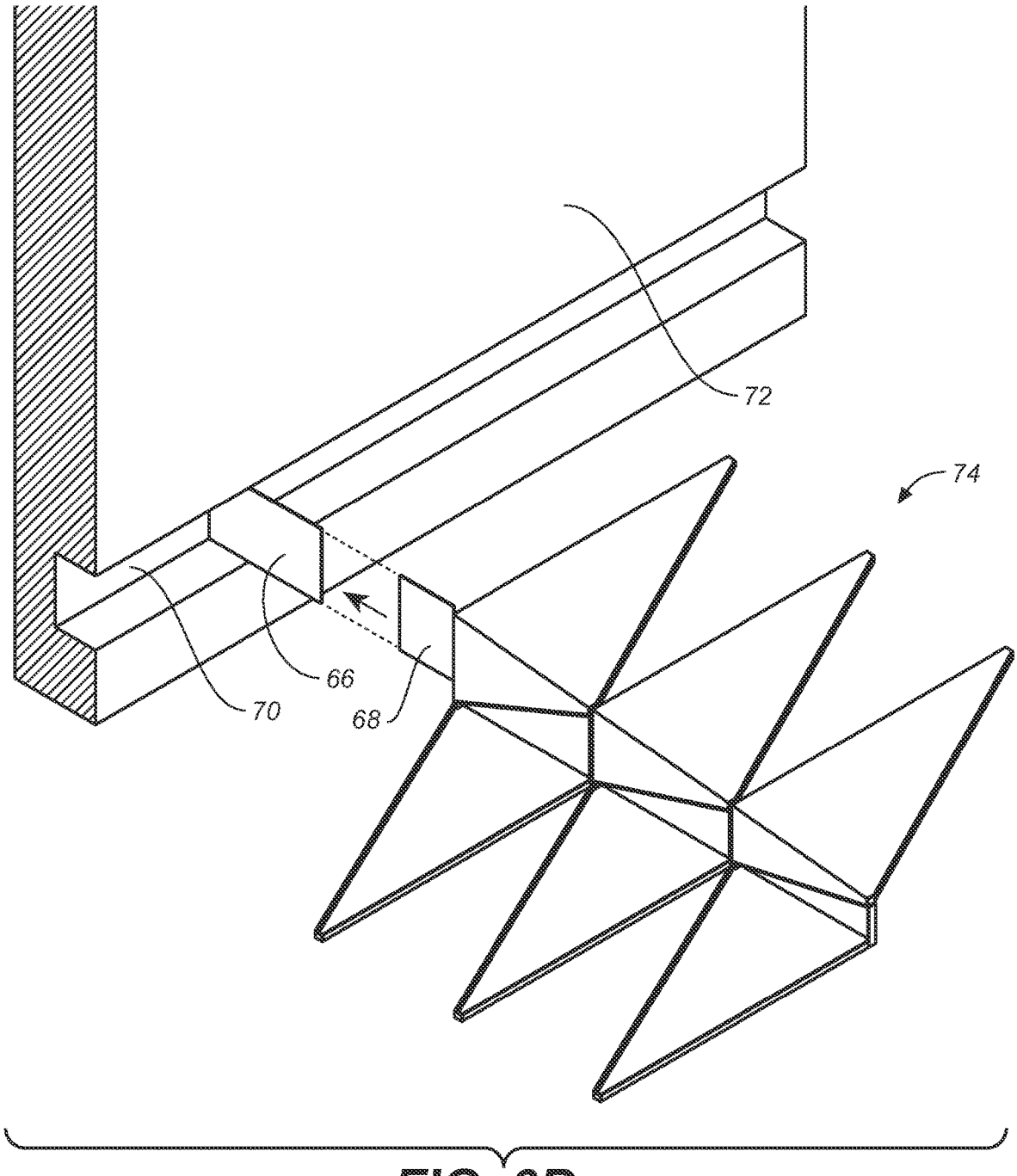
Figure 6C:
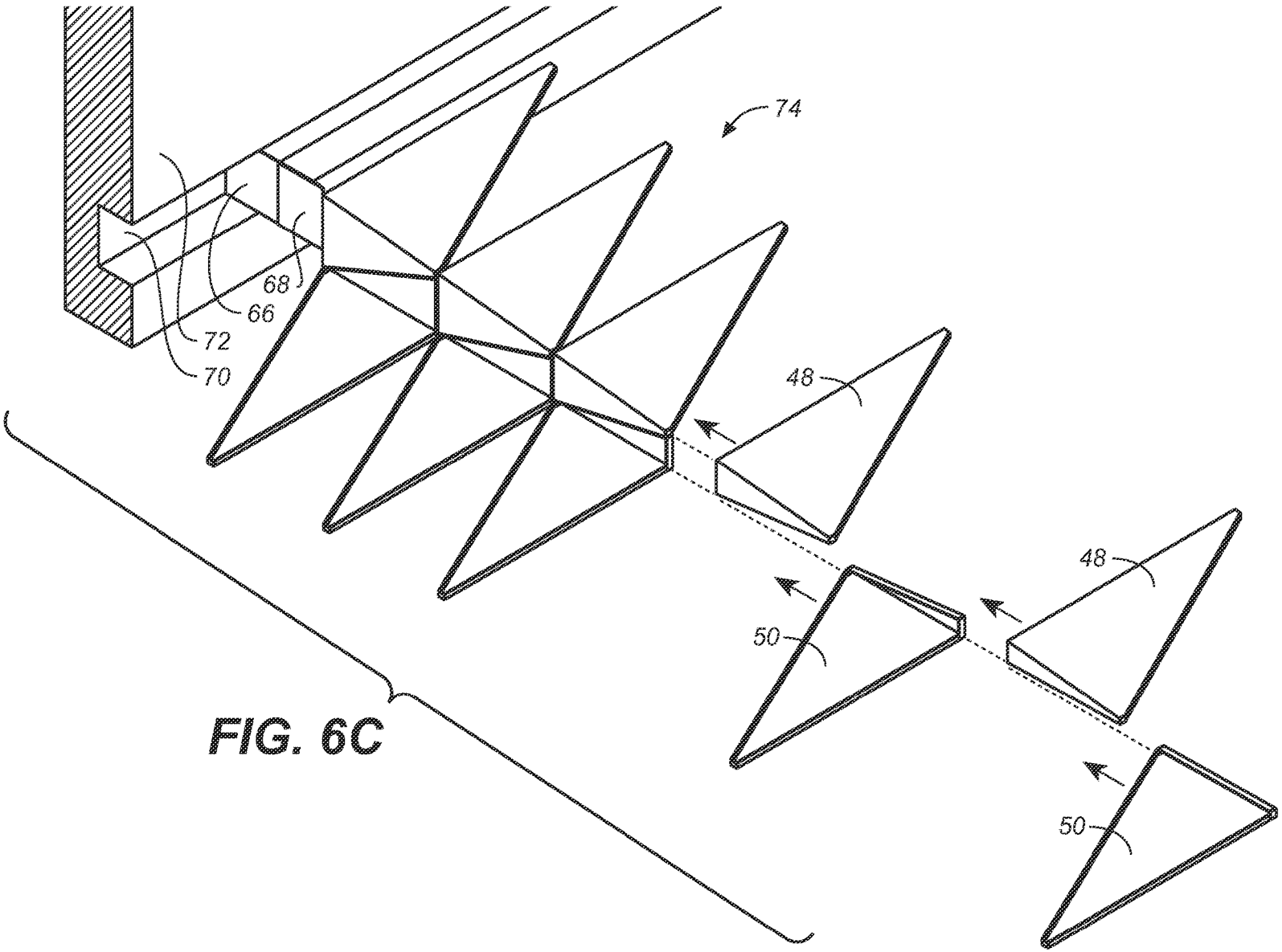
Figure 6D:
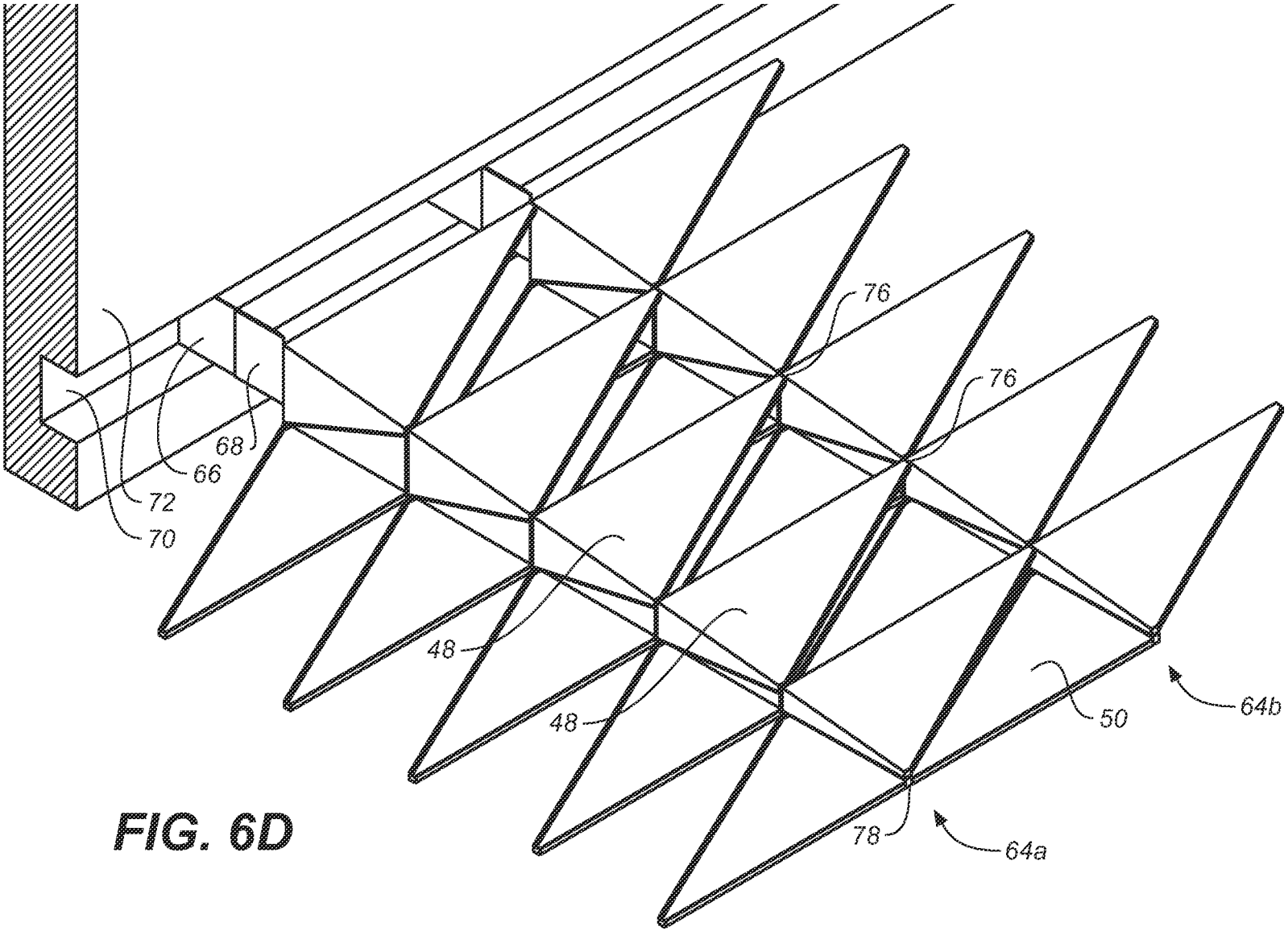

In one embodiment of the invention, embedment plate 66 may be installed in a recess 70 of the face 72 of a building as seen in FIG. 6A. With additional reference to FIG. 6B, a plurality of truss members may be preassembled into a starter assembly 74, which may include an anchor bracket 68, and which may be attached to the embedment plate 66, following which, as seen in FIG. 6C, individual truss members 48, 50 may be attached to the starter assembly 74 to extend the module a desired length from the face 72. This procedure is repeated to install adjacent truss modules 64 as shown in FIG. 6D. Finally, the ends of top truss members 48 of truss module 64A are attached to the corresponding truss members 48 of adjacent module 64B as at 76 and the ends of bottom truss member 50 are attached to the corresponding truss members of the adjacent module as at 78 to tie adjoining truss modules 64A, 64B together for lateral support. It will be readily understood that the shapes of truss members 48, 50 can vary and that the precise attachment points of truss members to adjacent truss modules may vary according to design specifications.

Figure 7:
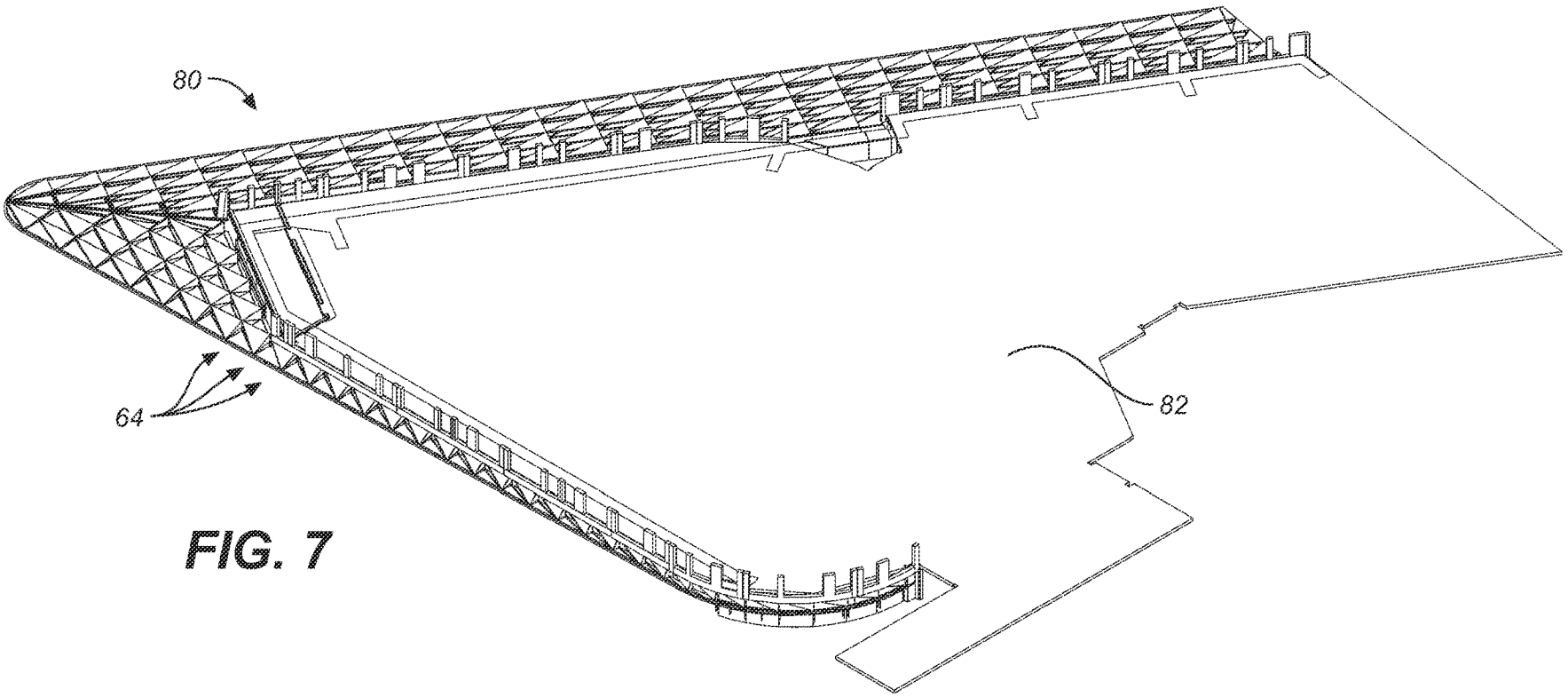
FIG. 7 is an upper perspective view of a cantilevered canopy installed on a building, the canopy formed from a plurality of cantilevered truss modules.

In the implementation of the invention shown in FIG. 7, a plurality of truss modules 64, in which the horizontal panels of each truss member are larger than the main panels and collectively form an overhead covering, has been assembled into a cantilevered canopy extending from the face of a building 82.

A truss formed as described above emulates the basic principles of a truss using sheet metal that is relatively thin relative to larger and heavier materials traditionally used to construct trusses. Trusses according to the invention can be manufactured at a lower cost by assembling trusses from a plurality of truss members each formed of folded sheet metal as described above. Trusses can advantageously be manufactured on the job instead of being prefabricated and shipped to the construction site. The cantilevered truss embodiment is sturdy, strong and eye-catching.

There have thus been described and illustrated certain embodiments of a truss and a cantilevered canopy formed from a plurality of trusses according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

We claim:

1. A truss formed of folded sheet metal, the truss comprising:

a plurality of truss members including first and second truss members, each truss member formed of a unitary folded blank, each of the truss members having a vertically disposed main panel, a proximal flange, a distal flange, and a horizontal panel, said proximal and distal flanges and said horizontal panel extending perpendicularly from the main panel, the proximal flange for connecting the truss member to a structure, the distal flange for connecting the truss member to the proximal flange of another of the plurality of truss members, the horizontal panel disposed substantially horizontally and having a surface area larger than that of the main panel, such that, when assembled, the first truss member is supported from the structure and the second truss member is supported distally from the structure by the first truss member and the first and second truss members form a truss extending away from the structure for supporting the structure or another structure and the horizontal panels of the plurality of truss members form an overhead covering.

2. The truss of claim 1 further comprising:

said blank comprising sheet metal.

3. The truss of claim 1 further comprising:

said blank consisting of sheet metal.

4. The truss of claim 1 further comprising:

the proximal and distal flanges and the horizontal panel are formed of portions of said blank that have been folded along fold lines that define the main panel.

5. The truss of claim 1 further comprising:

the main panel forming a triangle between the proximal and distal flanges and the horizontal panel.

6. The truss of claim 1 wherein:

each truss member comprises aluminum.

7. The truss of claim 1 further comprising:

an anchor bracket for securing the plurality of truss members to a structure, the anchor bracket attached to the proximal flange of the first truss member.

8. The truss of claim 7 further comprising:

an embedment plate for direct attachment to the face of a structure, the embedment plate attached to the anchor bracket.

9. A cantilevered canopy comprising:

a plurality of canopy modules, each module comprising:

a plurality of truss members including one or more pairs of interconnected first and second truss members, each truss member formed of a unitary folded blank of sheet metal, each of the truss members having a vertically disposed main panel, a proximal flange, a distal flange, and a horizontal panel, said proximal and distal flanges and said horizontal panel extending perpendicularly from the main panel, the horizontal panel disposed horizontally, the proximal flange for connecting the truss member to a structure, the distal flange for connecting the truss member to the proximal flange of another truss member, the horizontal panels of the truss members of each pair of interconnected truss members extending in opposite directions, the first truss member being supported from the structure and the second truss member being supported distally from the structure by the first truss member so that the plurality of truss members forms a truss, each of the plurality of canopy modules spaced apart, affixed to, and collectively forming a cantilevered canopy extending from the structure.

10. The cantilevered canopy of claim 9 further comprising:

one or more of the horizontal panels of the truss members of at least one of the plurality of canopy modules secured to the truss members of another of the plurality of canopy modules, thereby interconnecting the canopy modules.

11. The cantilevered canopy of claim 9 further comprising:

the horizontal panels of each of a first plurality of the truss members extending from the main panels thereof along a top fold line, the horizontal panels of each of a second plurality of the truss members extending from the main panels thereof along a bottom fold line disposed below said top fold line, such that the horizontal panels of the first and second plurality of truss members are vertically spaced apart, the horizontal panels of the first plurality of truss members collectively form a top surface of the canopy, and the horizontal panels of the second plurality of truss members collectively form a bottom surface below the top surface.

12. The truss of claim 11 further comprising:

the top and bottom fold lines of each truss member being disposed in a common vertical plane.

13. The cantilevered canopy of claim 11 further comprising:

the top and bottom surfaces forming a tapered profile.

14. The cantilevered canopy of claim 9 further comprising:

each of the horizontal panels of each truss member of each pair of truss members having a shape mirroring that of the horizontal panel of the other truss member of said pair of truss members.

15. The cantilevered canopy of claim 9 further comprising:

the main panel forming a triangle between the proximal and distal flanges and the horizontal panel.

16. The cantilevered canopy of claim 9 further comprising:

each of the horizontal panels having a triangular configuration.

17. A cantilevered canopy comprising:

a plurality of canopy modules, each module comprising:

a plurality of truss members including one or more pairs of interconnected first and second truss members, each truss member formed of a unitary folded blank, each of the truss members having a vertically disposed main panel, a proximal flange, a distal flange, and a horizontal panel, said proximal and distal flanges and said horizontal panel extending perpendicularly from the main panel, the horizontal panel disposed horizontally, the main panel forming a triangle between the proximal and distal flanges and the horizontal panel, the proximal flange for connecting the truss member to a structure, the distal flange for connecting the truss member to the proximal flange of another truss member, the horizontal panels of the truss members of each pair of interconnected truss extending in opposite directions, the first truss member being supported from the structure and the second truss member being supported distally from the structure by the first truss member so that the plurality of truss members forms a truss, each of the plurality of canopy modules spaced apart and extending away from the structure collectively forming a cantilevered canopy extending from the structure, one or more of the horizontal panels of the truss members of at least one of the plurality of canopy modules secured to the truss members of another of the canopy modules, thereby interconnecting the canopy modules, and the horizontal panels of each of a first plurality of the truss members extending from the main panels thereof along a top fold line, the horizontal panels of each of a second plurality of the truss members extending from the main panels thereof along a bottom fold line disposed below said top fold line, the top and bottom fold lines of each truss member disposed in a common vertical plane, such that the horizontal panels of the first and second plurality of truss members are vertically spaced apart, the first plurality of truss members collectively form a top surface of the canopy, and the horizontal panels of the second plurality of truss members collectively form a bottom surface below the top surface.

18. The cantilevered canopy of claim 17 further comprising:

each of the horizontal panels having a triangular configuration.

19. The cantilevered canopy of claim 17 further comprising:

each of the horizontal panels of each truss member of the one or more pairs of interconnected truss members having a shape mirroring that of the horizontal panel of the other truss member of said pair of truss members.

20. The truss of claim 1 further comprising:

the horizontal panel of at least one of said plurality of truss members having a triangular configuration.

* * * * *